United States Patent [19]

Sullivan

[11] Patent Number: 4,978,038

[45] Date of Patent: Dec. 18, 1990

[54] AEROSOL DISPENSER AND VALVE

[76] Inventor: Scott L. Sullivan, 3 Garden Ridge, Chappaqua, N.Y. 10514

[21] Appl. No.: 353,792

[22] Filed: May 18, 1989

[51] Int. Cl.[5] ..... B65D 83/14

[52] U.S. Cl. ..... 222/402.19; 137/43

[58] Field of Search ..... 222/211, 402.19, 402.18; 137/38, 43, 44

[56] References Cited

U.S. PATENT DOCUMENTS

| | | | |
|---|---|---|---|
| 3,447,551 | 6/1969 | Braun | 222/402.19 |
| 3,542,254 | 11/1970 | Samuelson et al. | 222/402.19 |
| 3,545,488 | 12/1970 | Venus | 222/402.19 |
| 3,733,013 | 5/1973 | Doyle | 222/402.19 |

*Primary Examiner*—H. Grant Skaggs

[57] ABSTRACT

A valve is provided for use with a pressurized dispenser of the type intended for both upright and inverted operation. The valve includes a valve body having an inclined inverting fluid chamber which houses a weighted ball. A pick-up tube is connected to each end of the inclined chamber, one is directed to the lower end of the container and the other to the upper end. The ball is movable within the inclined chamber between one end and the other and is adapted to close off one of the inlets, depending on which end it is located. External forces such as gravity or those forces developed during shaking or swirling movement of the container influence the location of the ball within the chamber. A stem portion of the valve includes an upper nozzle output and a lower divider portion. The divider is adapted to enter the inclined chamber during depression of the stem and retain the immediate location of the ball (one end or the other) prior to the valve opening. The ball's movement is prevented regardless of any external forces acting on the valve.

29 Claims, 4 Drawing Sheets

AEROSOL DISPENSER AND VALVE

This invention relates generally to pressurized dispensers such as those pressurized with an aerosol, and more particularly to dispensers adapted to operate in either an upright or inverted (downright) orientation.

Several variations of valve construction allow the liquid contents of a pressurized aerosol container to be dispensed from a single outlet in either an upright or inverted orientation. U.S. Pat. Nos. 3,447,551, 3,542,254, 3,893,596 and 4,723,692 are examples of such valve construction. The valve mechanisms disclosed in each of the above-mentioned patents all involve a weighted member, such as a ball bearing movable within a chamber. The ball is under the influence of gravity and therefore seeks the lowest point of the chamber. The ball is employed to close off various fluid passages connected to the chamber. The location of the passages within the chamber relative to the movement of the ball determines the characteristics of the invertible valve. In each case, the ball's position is dependent on gravity.

There are several problems associated with gravity dependency of invertible valves. Spray paint and automotive undercoating are two examples of products which are commonly dispensed from hand-held aerosol containers. If one of these two products is supplied within an aerosol container having an invertible valve like that shown in the prior art, the product will invariably clog the nozzle system because it is not possible to clean the nozzle after the product has been used. Containers without the invertible valve feature allow an operator to invert the container, exposing the sole internal input tube to the aerosol propellant and dispense a small amount of aerosol through the nozzle system to clean the output port. This procedure is not possible with the invertible dispensing containers of the prior art because with such prior art systems there is no way to invert the container and keep the valve mechanism "upright", against the influence of gravity because the gravity-based valve mechanism ensures that the liquid product is always dispensed and that aerosol propellant is never dispensed.

Another problem associated with the prior gravity-dependent invertible valve containers is that it is common for the user of such an aerosol product to continually shake or swirl the container during dispensing. For example, by shaking a spray can of paint while dispensing, the user is ensured that the paint within the can will stay mixed during the spraying procedure. This beneficial shaking action will not work with the prior invertible spray cans because the ball within the valve will move under the influence of the shaking movement. In such instance, the valve will not "know" the correct orientation of the can and will therefore malfunction by dispensing both aerosol propellant and paint at intervals corresponding to the rate of the shaking movement.

Another problem with prior art invertible valves is that since the ball used within the valve depends solely on gravity to determine the correct orientation of the container, it must be large enough to overcome the force exerted by the pressure of the aerosol. In other words, the sealing force of the ball (pulled by gravity) against a fluid passage opening must be greater than the pressure of the aerosol exerted on the ball at the fluid passage opening of the ball chamber. Otherwise, the pressurized aerosol will simply follow the path of least resistance and move the ball away from the fluid passage opening it blocks. This easier path will prevent the aerosol from pushing the liquid product up the pick-up tube to the valve. One possible solution to this problem is to use a larger ball, however, as the size of the ball increases to overcome the aerosol pressure, the cost and size of the valve also increases. An alternative solution to this problem is to use a small ball and decrease the size of the fluid passage openings entering the chamber so that the inlet pressure is low enough to prevent the pressurized aerosol from moving the ball within the chamber. However, with the size of the inlet ports reduced, the rate and efficiency of the product dispensed will be limited.

It is an object of the present invention to provide a pressurized container having a valve mechanism that allows a fluid product to be dispensed with the container in an upright or inverted orientation or any other position and which can selectively clean the dispensing system.

It is another object of the present invention to provide an upright-invertible dispensing valve that is inexpensive to manufacture, simple in construction and which can easily fit standard commercially available aerosol containers.

It is another object of the present invention to provide an upright-invertible dispensing valve that can operate under high aerosol pressures and therefore provide a high rate of dispensing flow using a relatively small gravity ball.

It is yet another object of the present invention to provide an upright-invertible dispensing valve that can be selectively "operation locked", preventing any operation of the valve, "orientation locked" into either inverted operation, upright operation, or unlocked to operate in either orientation.

The present dispenser comprises a container for holding a product to be dispensed which is capable of retaining a pressurized propellent. A valve assembly is attached to the container for controlling the dispensing of the product. The valve assembly includes a valve body having a fluid chamber and a valve stem which has an inlet and an outlet. The valve stem is movable within the valve body between a closed position where the valve stem inlet is not in fluid communication with the fluid chamber and an open position where the valve stem inlet is in fluid communication with the fluid chamber. A first valve inlet provides fluid communication between one portion of the container and the fluid chamber, while a second valve inlet provides fluid communication between another portion of the container and the fluid chamber. A closing member is positioned within the fluid chamber for closing one of the valve inlets, thus preventing fluid communication through it. The member is movable between the inlets within the fluid chamber under the influence of forces external to the valve. The position of the member within said fluid chamber is dependent on said external forces acting on said valve. Means is provided for retaining the closing member at one of the inlets independent of any external forces acting on the valve. The result is a dispenser that can operate in either an upright or inverted orientation, that will not be affected by shaking or swirling the dispenser while dispensing and that can provide a blast of propellent after its use for cleaning the nozzle system.

DETAILED DESCRIPTION OF THE PREFERRED EMBODIMENT

Figure 1:
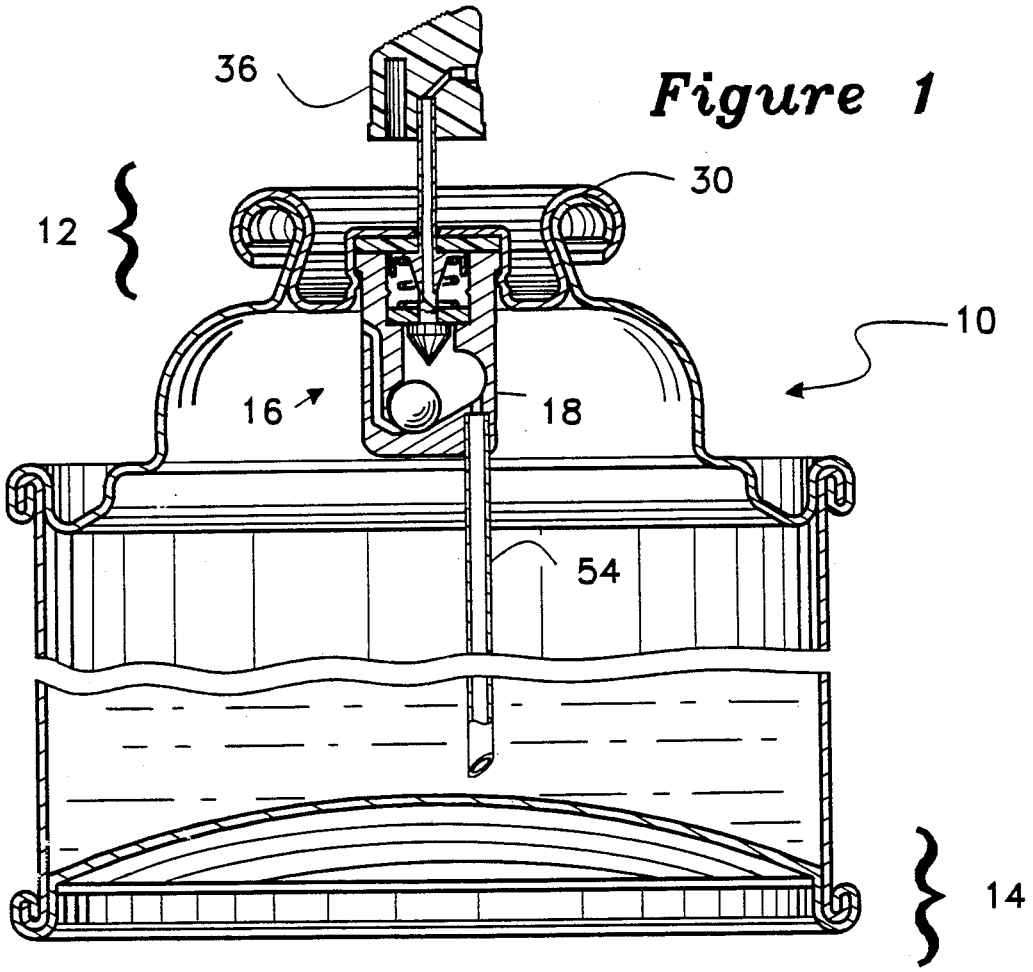
FIG. 1 is an axial section view of a preferred embodiment of the present valve installed in a conventional aerosol spray can.

Referring to FIG. 1, an aerosol can 10 is shown having an upper nozzle end 12 and a lower end 14. The terms "upper" and "lower" are used hereinafter relative to the aerosol can and valve in the upright orientation as shown in FIG. 1. A first embodiment of an improved valve 16 of the present invention is fitted adjacent the upper end 12 of the aerosol can 10. The valve 16 is shown in greater detail in FIGS. 3, 4 and 5. The valve 16 includes a valve body 18 having a tubular valve stem 20, an upper valve stem seal 22, a lower valve stem seal 24, a spring 26 for biasing the valve 16 to a closed position, and an inverting chamber 28.

The valve body 18 is adapted to be inserted into an opening in a standard sized spray can and sealed to the walls of the can in a conventional manner. The valve 16 is preferably cylindrical in shape so that it can be secured at a point within a spray can which is adjacent to the nozzle output end of the can. The valve 16 can fit, for example, into a similarly shaped recess 17 provided (through a conventional stamping process) in a sealing cap 30. After the valve body 18 is inserted into such a sealing cap recess, the walls of the cap can be spot-punched, thereby creating inwardly directed detents 31. These detents 31 make contact with the valve body 18 and hold it in place. It is desirable to also provide an outwardly directed flange 32 along the upper portion of the valve body 18. This flange 32 is adapted to engage with the detent 31 so that the valve body 18 is pushed upwardly against the upper stem seal 22. It is common practice to mount the valve assembly to (and through) the sealing cap 30 and later, after the product is introduced to the can, secure the sealing cap 30 to the can. The sealing cap 30 which seals the can and retains the pressure provided by the aerosol is attached to the can using a standard overlaying stamping procedure.

Figures 3, 4:
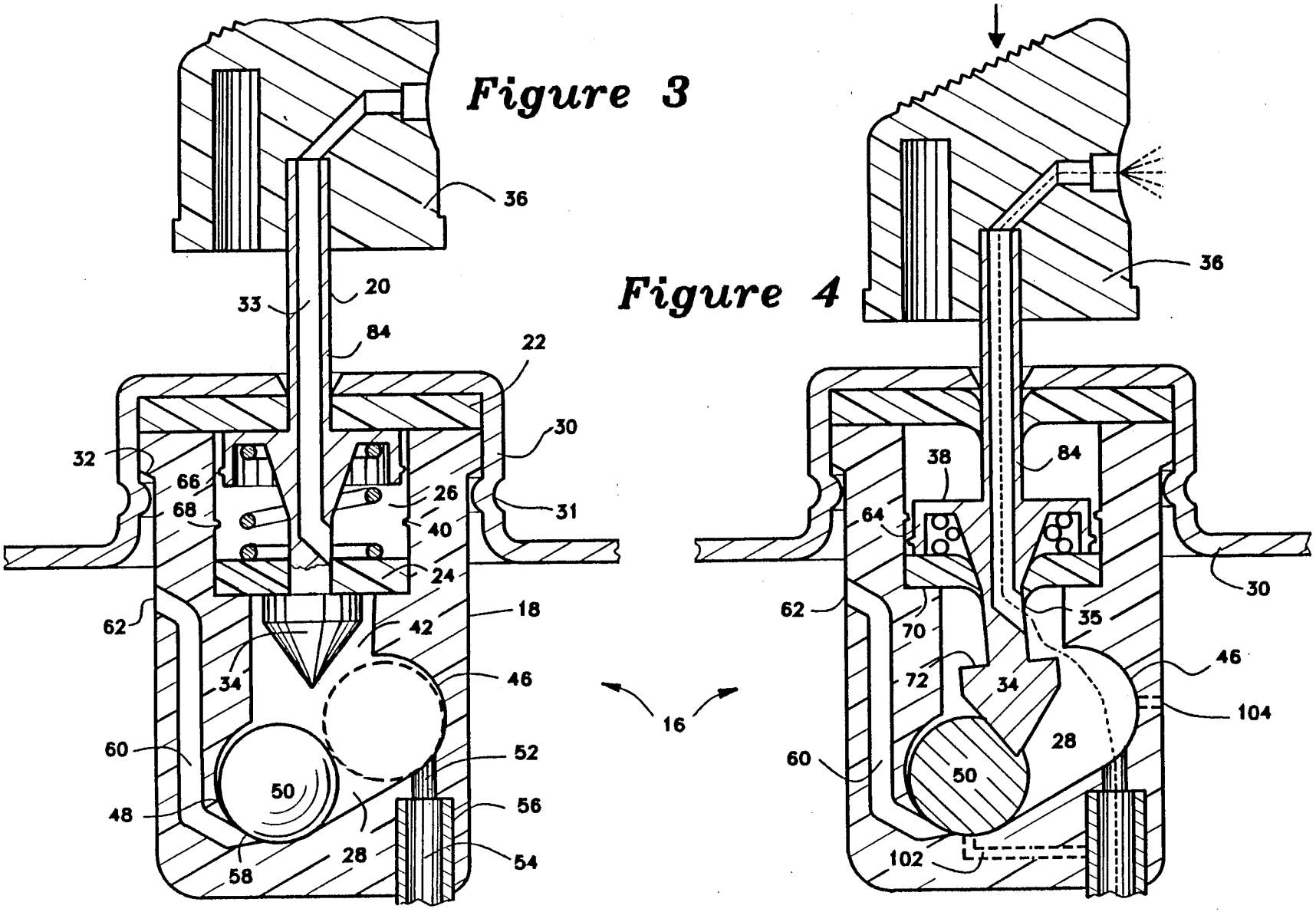
FIG. 3 is an axial section view of the preferred embodiment of the present valve in a "closed" and upright orientation.
FIG. 4 is an axial section view of the preferred embodiment of the present valve in an "open" and upright orientation.
Figure 5:
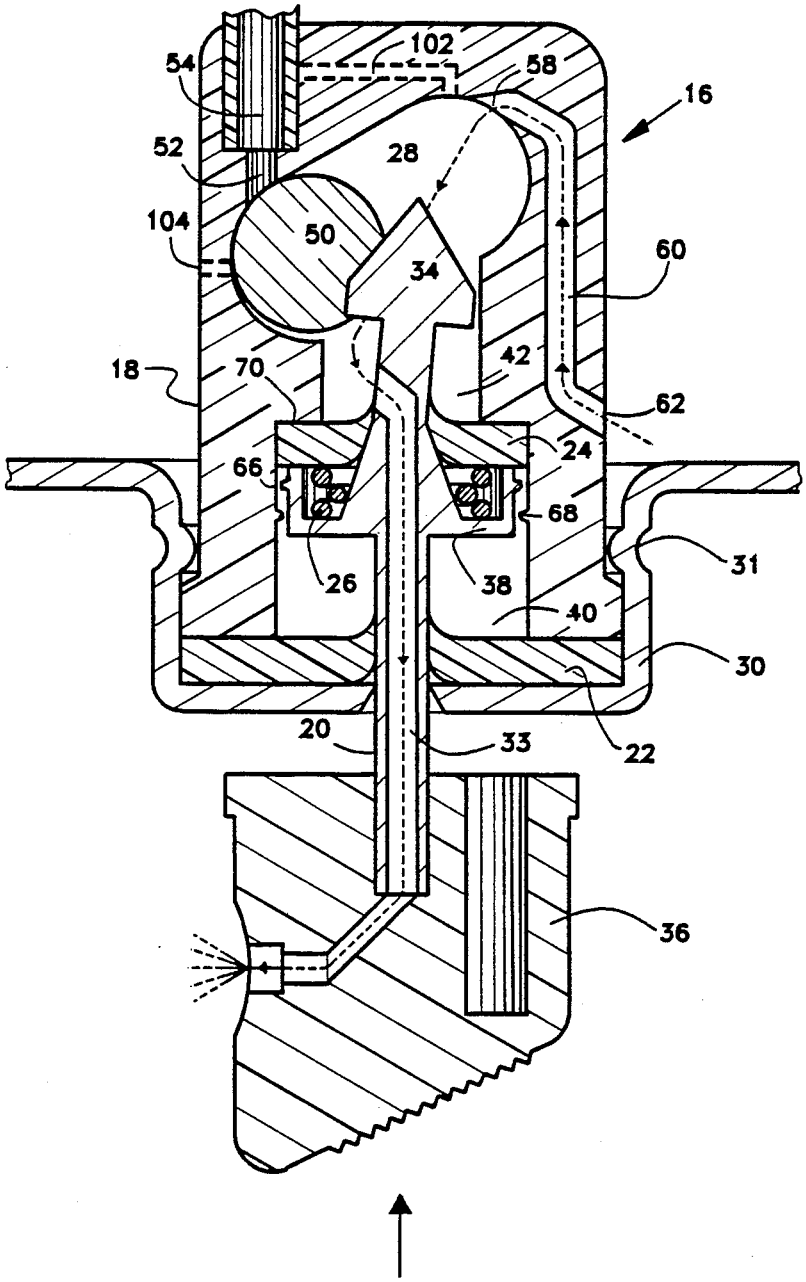
FIG. 5 is an axial section view of the preferred embodiment of the present valve in an "open" and inverted orientation.

As shown in FIGS. 3, 4 and 5 the valve stem 20 extends through the upper and lower valve stems seals 22 and 24 and through an opening in the sealing cap 30 and includes a central passage 33. One end of the valve stem 20 lies within the container and supports a divider 34 (explained below). The other end is outside the can and supports a conventional spray nozzle 36. The central passage 33 of the valve stem 20 extends from the spray nozzle 36 to an inlet port 35. With the valve 16 in the resting and closed position, the inlet port 35 lies at a point which is between the upper and lower stem seals 22 and 24, respectively. The valve stem 20 also has a spring support 38 which supports the upper portion of the spring 26. The upper end of the spring support 38 is preferably flat so that with the valve in a resting and closed position, the spring 26 pushes the flat portion of the spring support 38 against the upper stem seal 22. The spring support 38 will help maintain the upper seal 22 and prevent the seal from becoming deformed, as described further below.

Figure 6:
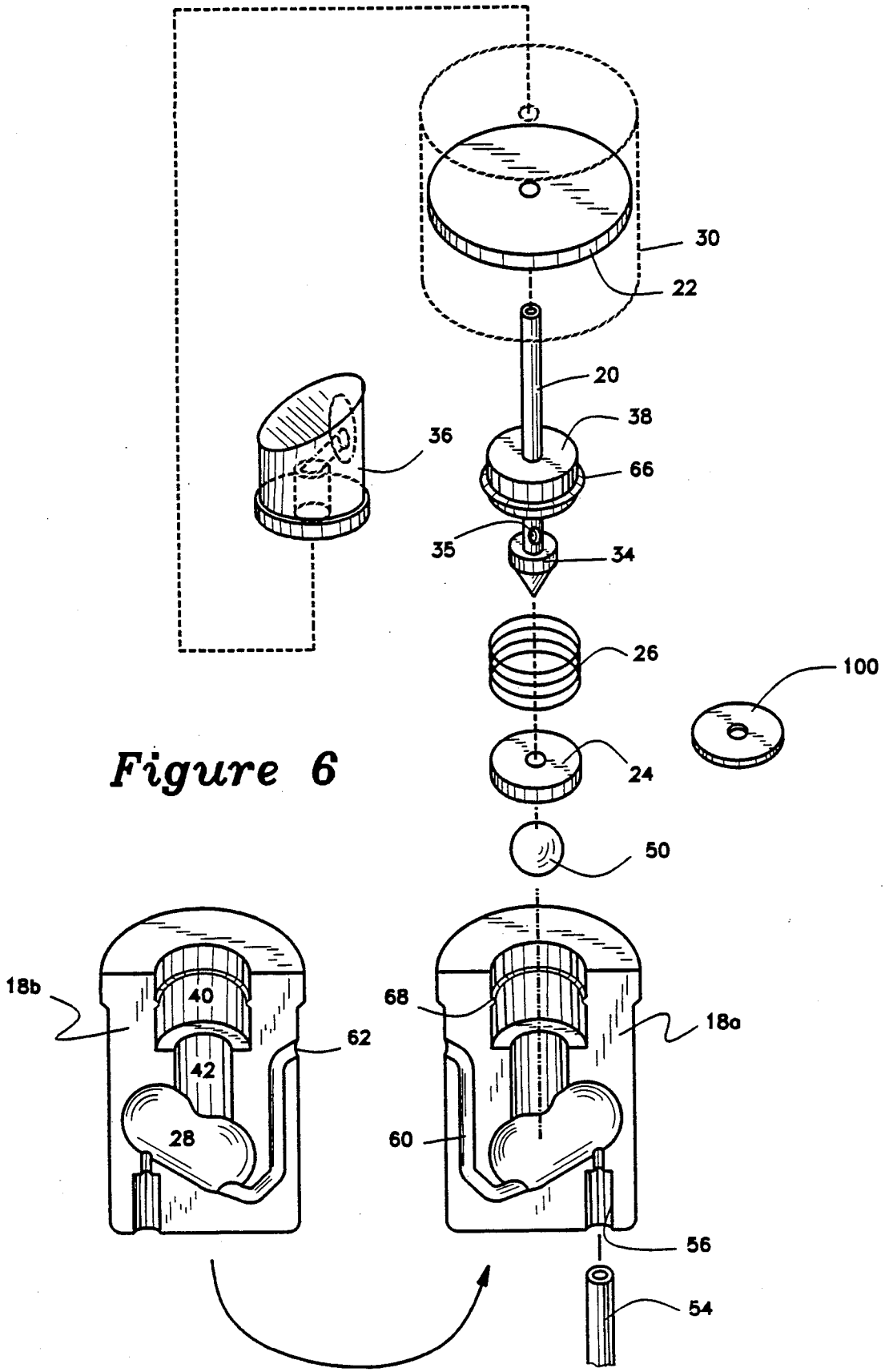
FIG. 6 is a exploded view of the present valve showing its assembly relationship.

The valve body 18 consists of three main sections; a spring recess 40, a divider compartment 42, and an inverting chamber 28. All three are preferably molded into the valve body 18 during its manufacture. The valve body 18 can be made by conventional molding methods such as first molding two valve body halves **18*a* and 18*b*, as shown in FIG. 6. The valve body halves 18*a*, 18*b* can be secured together to form a complete valve body 18. The valve body 18 can be made from any plastic or metal. A lightweight and strong plastic having resilient and surface lubricating properties is a preferred material for the valve body 18 of the present invention. A plastic such nylon can be used, as well as any other polyamide resin. The material used for the valve body 18** can also be coated inside the inverting chamber with a thin layer of a rubber material to enhance the sealing of individual inlet ports with a ball, as described below.

The inverting chamber 28 is substantially cylindrical with hemispherical ends, upper end 46 and lower end 48. The inverting chamber 28 is preferably formed into the valve body 18 at an incline between 30 and 45 degrees, as shown in FIG. 6. However, any incline from 0 to 90 degrees can be utilized.

A ball 50 is positioned within the inverting chamber 28. The ball 50 is preferably made from steel and has a diameter slightly smaller than that of the cylindrical inverting chamber 28 so that it can move freely within the inverting chamber 28 from one end to the other. In the final valve assembly, the ball 50 cannot escape the chamber 28. It is preferred that the inverting chamber 28 has a length which is slightly greater than one and one half times the diameter of the ball 50. Limiting the length of the chamber 28 will reduce the amount of product remaining in the chamber after spraying. This remaining product will be forced out during the cleaning procedure, described below.

Located adjacent upper end 46 of the inverting chamber 28 is an upright inlet port 52. A fluid pick-up tube 54 is connected to the upright inlet port 52 so that both are in fluid communication with each other. It is preferred that a cylindrical recess 56 is formed just below the upright inlet port 52. The recess 56 has a diameter which is slightly less than the outer diameter of the pick-up tube 54 so that one end of the pick-up tube 54 can be force-fit into the recess 56 and held in fluid communication with the upright inlet port 52. The recess 56, the pick-up tube 54 and the upright inlet passage 52 are shown in FIG. 6. The other end of the pick-up tube 54 extends to the bottom end 14 of the can 10.

A downright inlet port 58 is located adjacent the lower end 48 of the inverting chamber 28. A passageway 60 is molded into the valve body 18 and extends from the downright inlet port 58 to an opening 62 along the wall of the valve body 18 which is located adjacent the uppermost point within the can 10 that still maintains fluid communication with the liquid product when the can 10 is in the inverted orientation. The passageway 60 provides fluid communication between the inverting chamber 28 and the upper end 12 of the can 10 and is shown in FIG. 6.

The divider compartment 42 houses the divider 34. The compartment 42 is preferably cylindrical, extending from the lower end of the spring recess 40 to the upper end of the inverting chamber 28. The cylindrical divider compartment 42 is molded into the valve body 18 with a diameter which is slightly greater than the diameter of the ball 50 to simplify valve assembly as described below, and as shown in FIGS. 3, 4, 5, and 6.

It is preferred that the spring support 38, the divider 34, and the central passage 33 be formed as an integral part of the valve stem 20.

The divider 34 is an important feature of the present invention. It provides the operator of the spray can, control of the position of the ball 50 within the inverting chamber 28, independent of gravity or any other external forces acting on the valve or can 10, such as those developed during shaking or swirling movement of the can 10. Gravity will normally cause the ball 50 to move to the lower end 48 of the inverting chamber 28. As further described below, prior to the valve opening, the divider 34 enters the inverting chamber 28 and makes contact with the ball 50. The divider 34 pushes the ball against either the upright inlet port 52, as shown in FIG. 3, or against the downright inlet port 58, as shown in FIG. 5, depending on the position of the ball within the channel, which in turn depends on the orientation of the can 10 or the direction of any can movement. This ball securing feature allows the user to invert the can and spray straight aerosol through the valve to clean the valve and nozzle system. It is preferred that the divider 34 be an integral part of the stem 20 to simplify valve assembly and lower manufacturing cost.

Figure 2:
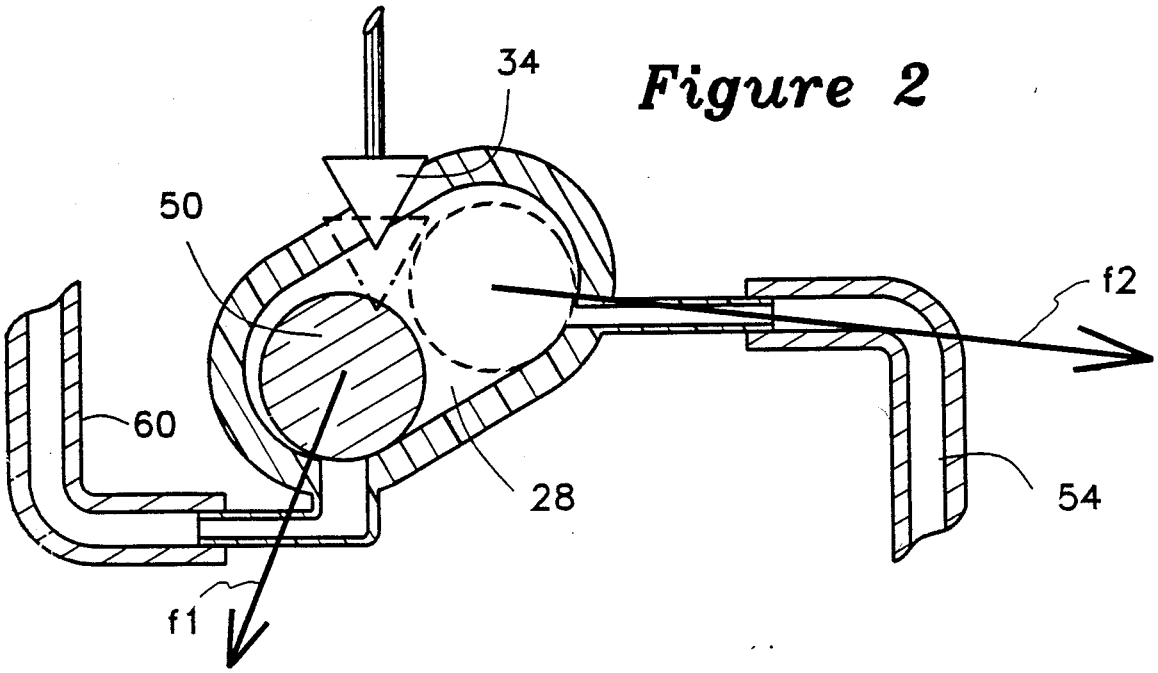
FIG. 2 is a section view of an inverting chamber utilizing the concept of the present invention.

Referring to FIG. 2, the concept of the present invention is represented. As the divider 34 enters the chamber 28, it will contact the ball 50 which is located either to the left as shown or to the right (in phantom). Further downward force to the divider 34 will be transmitted through the ball 50 to one of the two ends of the chamber 28. With the ball 50 to the left of the chamber, the vector force will be approximately in the direct represented by the arrow labelled fl. With the ball 50 located to the right in the chamber (in phantom), the applied force is represented approximately by f2. It is important to position the inlet ports 52 and 58 in the valve body 18 such that they lie adjacent to or on top of the vector lines f1 and f2 in order to effectively use the applied force as a port seal. The ball is used as a closing member, closing off either inlet port into the inverting chamber. The force directed by the divider forces the ball into a sealing engagement with the closest inlet port.

The divider 34 does not closely mate with the divider compartment 42 such that regardless of the divider's position, there will exist sufficient space between the divider 34 and the walls of the divider compartment 42 so that a fluid can pass freely through the divider compartment 42. It is preferred that the shape of the divider 34 be conical with a flat upper surface. Although the preferred shape of the divider 34 is conical, many different shapes can be used depending on several design factors of the valve including the size of the ball, the length and diameter of the inverting chamber 28, and the distance the stem 20 will travel before the valve "opens". As further described below in the Assembly section, since the divider 34 must penetrate a central opening located in the lower seal 24, it is preferred that the diameter of the base of the cone-shaped divider 34 not be so large as to cause damage to the central opening of the seal 24 during assembly penetration. The more resilient the material of the lower seal is, the larger the divider 34 the central opening will accept without damage.

It is preferred that the divider 34 enter the chamber 28 substantially in its middle so that it can persuade an indecisive ball 50 to move to one end or the other. However, since the chamber 28 is positioned at an angle with respect to the divider movement, the divider 34 will contact the ball 50 at upper end 46 before it would contact the ball 50 at lower end 48. To ensure that the ball 50 is securely held at either end of the chamber before the inlet port 35 passes below the lower seal 24, the divider 34 makes initial contact with the ball 50 and moves laterally opposite the ball 50 as the stem 20 is further depressed. This lateral movement of the divider 34 is shown in FIGS. 4 and 5. It is preferred that the stem 20 be made from a strong and resilient material such as nylon, so that the divider 34 will be allowed to move laterally within the divider compartment 42, as required to hold the ball 50 firmly at either end of the chamber 28. The stem portion that is located below the lower seal 24 will be able to take up the excess lateral movement the divider makes as it is pushed further against the surface of the ball 50.

The spring recess 40 is a cylindrical recess extending from the upper edge of the valve body 18 (just below the upper stem seal 22) to the upper portion of the divider compartment 42. The diameter of the spring recess 40 is greater than that of the divider compartment to facilitate easy valve assembly, as described below. In the preferred embodiment, the spring support 38 includes a downwardly directed wall portion 64 positioned circumferentially along the support 38, thus forming a thin-walled cylindrical wall portion 64. The wall portion 64 should extend downward, parallel to the walls of the spring recess 40 a finite amount. The lower edge of the wall portion 64 is used as a stop point to limit the downward movement of the stem 20. The spring recess 40 is adapted to accommodate the lower stem seal 24, the spring 26, and the spring support 38 including the wall portion 64, as shown in FIGS. 3, 4 and 5. It is desirable that the outer diameter of the wall portion 64 be substantially similar to the inner diameter of the spring recess 40, but not so similar to prevent smooth movement of the stem 20 within the spring recess 40. A circumferential detent 66 is provided at a selected point around the outer surface of the wall portion 64, parallel to both the spring support 38 and the lower edge of the wall portion 64. A similar detent 68 is provided at a selected point around the inner wall surface (the only surface accessible) of the spring recess 40. These detents 66, 68 are positioned relative to each other such that they will engage at some point during the downward (or upward) travel of the valve stem 20. The desired point of contact in this preferred embodiment is the point when the tip (lowermost portion) of the divider enters the path of the ball 50 in the inverting chamber 28, thereby preventing passage of the ball 50 from one end to the other. When this point is reached during nozzle (and stem) depression by the user, the detents 66 and 68 will make contact. In this embodiment, the engagement of the detents 66, 68 should not be so great as to prohibit movement (either up of down) of the valve stem 20 but just enough to create a "snap" as their engagement is overcome by either the continued depression of the valve stem 20 by the user or the rise of the stem 20 by the spring 26. This "snap" is meant to be felt by the user to indicate that the ball 50 cannot move to the other side if the can 10 is inverted or otherwise moved or shaken, as further described below. The detents 66, 68 can easily be incorporated with the mold used to form the valve body 18 and the valve stem 20. The detents are shown in the valve body halves 18*a*, 18*b* in FIG. 6.

Located at the bottom of the spring recess 40 is the lower stem seal 24. The lower seal 24 is supported by a circumferential ridge 70 which is defined by the difference between the larger diameter of the spring recess 40 and the divider compartment 42. The spring 26 is of the compressible type and has a coil diameter whose magnitude is between that of the diameters of the divider compartment 42 and the spring recess 40 such that it lies on upper surface of the lower stem seal 24 above the ridge 70 and around the valve stem 20. The spring 26 should have a resting length whose magnitude is slightly greater than the length between the spring support 38 and the upper surface of the lower stem seal 24, depending on the type of aerosol used, the container pressure and the greatest dispensing rate. In the assembly valve, the spring 26 should rest in a compressed state, compressing further during valve opening. The compressed spring at rest increases the sealing characteristics of the seals 22 and 24 by exerting a downward force which pushes the lower stem seal 24 against the ridge 70 and simultaneously providing an upward force against the spring support 38 which, in turn, pushes the upper stem seal 22 against the sealing cap 30.

The seals 22 and 24 are made from any conventional sealing material, such as natural rubber or synthetic rubber including silicone. The upper seal 22 and the lower seal 24 can be stamp-cut to fit in the sealing cap 30 and the spring recess, respectively. A centrally located opening for receiving the valve stem 20 can also be stamp-cut. In the present invention, to ensure seal longevity and efficiency, it is desirable to maintain each seal's resting shape i.e., flat, especially around the central opening. To accomplish this and also create a lower seal 24 which can withstand a greater pressure differential, the present valve provides the upper portion of the divider 34 with a flat ridge 72 which rests substantially coplanar with the ridge 70. Since the lower seal 24 is at rest with the stem 20 in the high point of its travel, any deformation to the seal 24 (during valve opening) will be directed downward. As the valve stem rises, the ridge 72 prevents permanent downward deformation of the lower seal 24 by forcing the downwardly directed portions of the seal (caused by the valve opening procedure, described below) back to the lower seal's preferred flat resting state.

Similarly, the upper stem seal 22 is forcefully reflattened during each closing operation by the flat upper surface of the spring support 38.

It is also important to ensure that the lower stem seal will deform consistently (downward) during downward movement of the valve stem 20 (valve opening). To accomplish such consistency in downward seal movement (for the lower seal 24), a conical ridge 74 is provided around the valve stem 20 between the spring support 38 and the inlet port 35. The preferred stem assembly is shown in FIGS. 3–5, and 9 including a conical ridge 74 that is located just above the inlet port 35.

In another embodiment of the present aerosol valve, the valve stem 20 is lockable in a slightly depressed position. In this embodiment, the detents 66 and 68 extend far enough from their respective surfaces to prevent passage of each other. The detent 66 extends only a portion of the circumferential surface of the wall portion 64 of the spring support 38. The other detent 68 also extends only a portion of the circumferential surface of the spring recess 40. The circumferential coverage of each detent 66, 68 can vary depending on the desired locking effect. In this preferred locking embodiment, the detent 66 covers approximately 90 degrees of the circumference of the wall portion 64. The other detent 68 covers preferably covers approximately half (180 degrees) of the circumference of the wall surface of the spring recess 40. The "open" region of the detent 68 or the half of the wall of the spring recess 40 not covered by the detent 68 can be so indicated by a mark (perhaps colored) on the outer surface of the sealing cap 30, adjacent the nozzle 36. The nozzle 36 can be secured to the upper portion of the stem 20 so that the stem 20 can be easily rotated via turning the nozzle 36. The nozzle output is preferably directed towards the midpoint of the detent region 66 of the spring support wall. With this arrangement, the operator of the can 10 can determine the relative location of the locking detents 66, 68. If the nozzle 36 is pointed within the colored markings on the sealing cap 30, the detent region 66 will not engage with the detent portion 68 and the stem 20 can be depressed without interference from the detents 66, 68.

If the nozzle 36 is pointed within the colored markings, the detents 66 of the spring support 38 will engage the upper surface of the detent 68 on the spring recess wall. In this position, the stem 20 will be unable to be depressed past the engaged detents 66, 68 and the valve 16 will become inoperative, an operational lock of the valve. This allows the user to "lock" dangerous products from unintended application by children, for example.

If the user first depresses the nozzle 36, with it pointing within the colored region of the sealing cap 30, and prior to "opening" the valve, turns the nozzle out of the "unlocked" zone (out of the colored marking), the detents 66, 68 will become engaged and will prevent the nozzle 36 and the stem assembly 20 from rising, against the action of the spring 26. In this "orientation locked" position, the tip of the divider is located in the path of the ball 50 in the inverting chamber 28 preferably engaged with the ball's surface. With the valve "locked" in this position, the divider 34 will prevent movement of the ball 50. The valve stem 20 has not moved downward enough to open the valve 16. The valve 16 remains closed with the inlet port 35 positioned above the lower surface of the lower stem seal 24.

With the valve 16 in the "orientation locked" and closed position, the user can further depress (without turning) the nozzle 36. This depressing action will cause the divider 34 to move further downward into the inverting chamber 28, pushing the ball 50 into sealing engagement with its nearest port 52 or 58. Further depressing the nozzle 36 will simultaneously move the inlet port 35 downwardly until it passes below the lower edge of the stem seal 24 and opens the valve. If the nozzle 36 is released, the valve stem 20 will rise under the action of the spring 26. The detent 66 of the spring support 38 will eventually make contact with the detent portion 68 on the spring recess wall. This contact will cause the valve stem 20 to stop rising. It is preferred that when the detents contact each other, the inlet port 35 be located just above the lower stem seal 24 and that the divider 34 remain within the path of the ball 50 in the inverting chamber 28.

The purpose of the "orientation lock" mechanism of the valve 16 is to allow the user of the can 10 to choose the operational orientation of the valve 16, either upright or downright. For example, if the user engages the valve 16 into the "orientation locked" position, as described above, with the can in an upright orientation, the ball 50 will be held by the divider 34 against lower end 48 of the inverting chamber 28 and the valve 16 will thereafter spray the liquid contents of the can 10 only with the can in the upright orientation. Similarly, if the valve 16 is "orientation locked" with the can 10 inverted, the ball 50 will be held by the depressed divider 34 against upper end 46 of the inverting chamber 28 and will only dispense the liquid contents of the can 10 with the can inverted. If, in this later example, the can 10 is operated in an upright orientation (i.e., with the ball held at the upper end 46, against the action of gravity), the only "open" pick-up tube will be passageway 60 which is surrounded only by aerosol. The valve 16 will then allow the aerosol alone to enter through the valve 16 and out the nozzle 36. This action will clean the valve 16 and nozzle 36. The cleaning procedure just described can also be performed with the valve "orientation locked" in the inverted orientation and the can 10 sprayed upright.

The valve 16 can become unlocked from the "orientation locked" position simply by turning the nozzle 36 so that the detent 66 moves out of overlapping engagement with the other detent 68 thus removing the force holding the valve stem 20 in the slightly depressed condition against the action of the spring 26. Once disengaged, the stem assembly 20 rises from the action of the spring 26. As the stem assembly rises, the divider 34 moves out from the path of the ball 50 in the inverting chamber 28, allowing the ball 50 to again move freely from chamber end to end 46, 48, as dictated by gravity.

A colored band 84, preferably green, is located around the valve stem 20 at a point which lies just above the upper stem seal 22 to indicate when the valve 16 is in the "orientation locked" position. In the closed and out of the "orientation locked" position, the green color of the colored band 84 can easily be viewed by the user, indicating a non "orientation locked" condition. In the "orientation locked" condition of the valve 16 or when the divider 34 has moved downwardly into engagement with the ball 50, the colored band 84 will also move downwardly past the upper seal 22 and will be hidden from view, indicating a "orientation locked" condition or at least that the ball 50 cannot move within the inverting chamber 28. If the valve 16 is in the "orientation locked" position, the colored band 84 will not be in view regardless of the depressing force on the nozzle 36.

Referring to FIG. 6, the valve of the present invention can be assembled quickly and easily without any need for special tools. The stem 20 is first molded, preferably from a plastic, incorporating the spring support 38, the conical ridge 74, and the divider 34 in the same mold. Although it is preferred to mold the entire stem assembly in one step, the assembly can also be made by attaching a separately formed divider 34 to one end of a tube (stem 20) and then attaching a separately formed spring support 38 integral with the conical ridge 74 using a conventional heating procedure or an appropriate adhesive. A less expensive spring support can be used in place of the preferred one shown in FIG. 6. Such a support alternative could entail piercing the tubular stem with a length of rod made from steel or hard plastic at a point along the stem 20 which is equivalent to the location of the bottom surface of the preferred spring support 38. The rod (not shown) would have a length similar to the diameter of the preferred spring support 38 and have a wire diameter which is substantially smaller than the inner diameter of the central passage 33 so as not to interfere with any dispensing fluid therein. As stated above, the lower end 48 of the tubular stem 20 could be shaped to a point which could substitute the preferred divider 34. Finally, continuing with the preferred stem assembly the inlet port 35 is either drilled separately in the location shown or its creation is included in the mold. If a length of tubing is used as the stem 20, the lower end 48 of the tube must be sealed to prevent unintentional fluid communication with the inverting chamber 28. In most stem arrangements the lower end 48 of the stem will be sealed by the attached or formed divider 34.

The valve body 18 is preferably made by first forming two separate and mating valve body halve **18*a*, 18*b*, and then securing the two halves together using standard heat-sealing techniques or an adhesive to create the preferred valve body 18. Each valve body half 18*a*, 18*b* is formed with one half of all recessions located in the final valve body 18 including the inverting chamber 28, both inlet ports 52, 58, the divider compartment 42, the spring recess 40, the passageway 60, the opening 62, and the pick-up tube recess 56. The two valve body halves 18*a*, 18*b* are shown in FIG. 6**.

To assemble the valve 16, first, the ball 50 is inserted into the formed valve body lB. The ball 50 (preferably steel) easily falls through the spring recess 40, the divider compartment 42 to the inverting chamber 28. The spring 26 is positioned around the formed stem assembly, nesting its upper portion within the cup-like spring support 38. The lower seal 24 is been formed as described above. The central opening of the seal and is pushed into position around the stem 20 over the formed divider 34. The opening of the seal 24 closes around the stem 20 just below the inlet port 35 and abutting the ridge 72 of the divider 34, against the action of the now slightly compressed spring 26. The larger upper seal 22 is similarly formed and positioned around the stem 20, resting on the upper surface of the spring support 38.

The stem assembly including both seals 22, 24 and the spring 26 is simply inserted into the spring recess 40 of the valve body 18. The divider 34 will reach the divider compartment 42. The lower seal will abut the ridge 70. The upper seal 24 will rest with the upper surface of the spring support 38 slightly above the top surface of the valve body 18 owing to the spring length 26. The valve assembly is inserted into a recess pre-stamped in the sealing cap 30 (shown in FIG. 6 in phantom). The sealing cap recess includes a central opening which will receive the outlet of the stem 20. The sealing cap recess receives the valve assembly until the upper seal 24 comes into contact with the inner ceiling of the sealing cap recess. It is preferred that the valve assembly be pushed tightly into the cap recess while the above mentioned sealing cap recess walls are point-punched into contact with the walls of the valve body 18, just below flange 32. The nozzle 36 can be attached to the protruding stem 20 when desired. The upper pick-up tube is incorporated with the valve body 18 and a pre-cut length of lower pick-up tubing 54 can be forced into the recess 56 when desired to complete the valve assembly.

In operation, referring to FIGS. 3, 4 and 5 with the spray can 10 in an upright orientation, the ball 50 will reside at lower end 48 of the inverting chamber 28. As the user begins to depress the nozzle 36 the attached valve stem 20 moves downward against the action of the spring 26. Before the inlet 35 passes below the lower edge of the lower seal 24, the divider 34 enters the inverting chamber 28 and makes contact with the ball 50. Further depressing the nozzle 36 causes the divider 34 to force the ball 50 into tight engagement against lower end 48 of the inverting chamber 28, as shown in FIG. 4. This force causes the ball 50 to create a tight seal around the downright inlet port 58. With the downright inlet port 58 sealed off, no fluid can enter through opening 62 or passageway 60.

During further depressing of the nozzle and stem 20, the stem inlet port 35 will eventually move below the lower edge of the lower stem seal 24. When this happens, the valve is "open". The relatively low atmospheric pressure will cause the higher pressure aerosol to force the liquid product (such as paint) which is residing at the bottom of the can 10 (due to gravity) through the pick-up tube 54, the upright inlet port 52, into the inverting chamber 28, through the divider compartment 42 (past the divider 34), into the stem inlet port 35, through the central passage 33 and finally out the nozzle 36.

When the user removes the downward force on the nozzle 36, the valve stem assembly will rise due to the biasing force of spring 26. When the stem inlet port 35 passes above the lower stem seal 24, the valve will close and the spray of paint will cease. At this point however, the divider 34 will maintain it's hold on the ball 50 at the lower end 48 of the inverting chamber 28. Further rising of the divider 34 will eventually allow the ball 50 to move within the inverting chamber 28.

To clean the nozzle system by allowing straight aerosol (without the liquid product) to escape through the valve assembly 16 and the nozzle 36 the user must first position the can 10 in either the upright or downright orientation so that gravity will cause the ball 50 to fall to whichever end is lower (either 46 or 48) of the inverting chamber 28. Depressing the nozzle 36, as described above will cause the divider 34 to enter the path of the ball 50 and force it to one end 46, 48 of the inverting chamber 28. The ball will thereafter seal either the downright inlet port 58 or the upright inlet port 52 depending on the initial orientation of the can 10. After the ball 50 is in tight engagement around either inlet port 52 or 58 and prior to the opening of the valve 16, the user must turn the can 10 from the initial orientation to an inverted orientation. Since the ball 50 is being held by the divider 34, it will not fall to the new lowest end of the inverting chamber 28. Whichever inlet port 52, 58 remains unblocked by the held ball 50 will allow straight aerosol from the can 10 to pass through and clean the valve/nozzle system upon the opening of the valve 16. The ball 50 remaining held during the cleaning procedure will prevent the liquid product (such as paint) from entering the adjacent inlet port 52 or 58. The cleaning procedure will remove any excess liquid product (paint) from the inverting chamber 28.

The user can also operate the spray can of the present invention in an upside-down (downright) orientation as certain applications warrant. When the can is turned upside-down, the liquid product (paint for example) being heavier than the aerosol will fall to the lowest point of the can 10, which in this case would be at the upper (nozzle) end 12. The aerosol will rise above the liquid in response to the relocation of the liquid. The ball 50, being free to move because the nozzle has not yet been depressed, will fall to the lowest point in the inverting chamber 28, which in this case is end 46. As the nozzle 36 is depressed, similar to the upright valve operation discussed above, the ball 50 will seal the upright inlet port 52 with the force exerted by the depressed divider 34. After the valve 16 "opens", the aerosol is allowed to push the liquid product through the submerged opening 62, through passageway 60 and downright inlet port 58, through the divider compartment 42, the exposed stem inlet port 35, the central passage 33 and finally, out the nozzle 36. The valve closing procedure remains the same as described in the above upright operation.

The above operating procedures can include the previously discussed locking procedure for keeping the divider 34 in the path of the ball 50 at all times.

It is further contemplated that the inverting chamber 28 of the present invention may include more than one inlet port, such as a centrally located third port (not shown). The inverting chamber 28 would, in this case, include an addition concave recession located approximately in the middle of the chamber 28 that would accept the ball 50 when the container is in a particular orientation. The divider 34 in this new embodiment would be shaped such that the force applied to the stem will allow the divider 34 to hold the ball 50 at either end 46, 48 or in the middle recession (not shown). With this embodiment, the container could include three isolated compartments, each connected to one of the three inlet ports. The user could then select and maintain a particular product to dispense by orienting the container in a selected manner.

In the above preferred embodiment, the stem 20 is shown to bend against the surface of the ball 50 during stem assembly depression. The valve assembly 16 can be designed in other embodiments so that the lower edge of the spring support walls will stop the stem assembly from further downward movement after the divider has contacted the ball 50 (in any valve orientation) but before the stem 20 bends. Also, in another embodiment a thin nylon washer 100 is inserted into the spring recess 40 between the lower stem seal 24 and the spring 26. The nylon washer 100 can be used to support the stem 20 against bending. Depending on the material used for the lower stem seal 24, the seal may deform laterally due to excessive stem bending. The nylon washer 100 provides support in such instances and prevents lateral deformation of the lower seal 24. The nylon washer 100 is shown to the right of the lower stem seal 24 in FIG. 6. The nylon washer is preferably no thicker than the lower seal 24 and includes a central opening whose diameter is slightly greater than the outer diameter of the stem 20. The outer diameter of the entire washer 100 is preferably equal to the outer diameter of the lower seal 24.

The use of two stem seals 22, 24 in the above embodiments is by choice. In the above embodiments, the present valve requires depression of the stem portion a sufficient distance to "catch and hold" the ball prior to the "opening" of the valve. The stem inlet port 35 can travel as much as a ¼ of an inch before passing below the lower seal 24. The distance traveled by the inlet port of course depends on the valve's specific design and construction. It is desirable, however, to protect the inlet port 35 from exposure to the outside of the can 10. The preferred embodiment protects the inlet port 35 and the lower stem seal 24 by positioning the vulnerable parts of the valve within the spring recess 40. The upper stem seal 22 is used to seal the upper edge of the valve housing 18 with the sealing cap 30 and to prevent any contaminants from entering the spring recess 40 from outside the can 10. Other embodiments of the present valve can, however, utilize a more conventional single seal system. Other divider 34 shapes can be designed to "catch and hold" the ball 50 more quickly without requiring any great displacement of the stem 20 into the can 10.

The preferred valve 18 shown in FIGS. 3, 4 and 5 can be used to dispense a great number of products including paints, hair sprays, insect repellant, automotive engine cleaners and automotive undercoating tar. Using a conventional nozzle and an aerosol propellent these products will dispense in a spray. Other nozzles can provide a stream of dispensed product. With some products, however, it is necessary to not only use the aerosol propellant to push the liquid product up a pick-up tube but also to mix a controlled amount of the aerosol propellant with the liquid product prior to it reaching the nozzle portion of the valve. The mixing can occur anywhere prior to the nozzle outlet, but generally is done in the valve housing. The present valve assembly can accommodate those products which require a controlled mixing of the liquid product with the aerosol propellant. In such an embodiment, additional passageways must be created within the valve housing For clarity, these passageways 102, 104 are only shown in FIGS. 4 and 5, in phantom, and are only required for the particular embodiment described here.

In operation of this particular embodiment, with the aerosol container in the upright and open orientation, as shown in FIG. 4, the ball 50 will seal-off the downright inlet port 58, as described in the above description of the preferred embodiment and also one of the additional passageways 102, as shown. The aerosol propellant will push the liquid paint (for example) up the pick-up tube 54 to the valve's inverting chamber 28. Aerosol also enters the inverting chamber 28 through the other additional passageway 104, which is not being blocked by the ball 50. The passageways 102, 104 are precisely sized to allow a controlled amount of aerosol into the inverting chamber 28 in proportion to the amount of liquid paint entering the chamber. The aerosol and paint mix in the inverting chamber 28 and provide the desired outlet spray characteristic.

In the inverted orientation, as shown in FIG. 5, the ball 50 switches positions and now seals the upright inlet port 52 and the passageway 104. In this case, a double lumen pick-up tube is used (not shown). One main lumen for the passage of paint when the can is upright and a smaller one for the passage of aerosol when inverted. The passageway 102 is connected to the smaller lumen of the pick-up tube and is open to the inverting chamber 28 (with the can inverted). As described above, paint enters the inverting chamber 28 through the passageway 60. Aerosol now enters the chamber 28 through the small lumen of the pick-up tube and the passageway 102 to mix with the liquid paint to create a similar outlet spray characteristic as before.

In yet another embodiment, a nozzle is used which will dispense a liquid in a spray format when the liquid dispensed is pre-mixed with aerosol prior to dispensing, as described above, and will dispense the liquid in a stream format when the liquid is just pushed out the nozzle without the aerosol pre-mixing. To achieve these outlet characteristics, the passageway 104 is retained, but the other passageway 102 and the small lumen of the pick-up tube are not used. Following the above operation descriptions, in the upright orientation, this particular embodiment of the valve will dispense in a spray format, with the aerosol entering the inverting chamber 28 through passageway 104. The inverted valve, however will not be pre-mixed with the aerosol because there is no passageway to accept the pure aerosol. Therefore, with the can 10 in the inverted orientation, a stream format of the liquid product will be dispensed

What is claimed is:

1. A pressurized dispenser comprising:

a container for holding a product to be dispensed, said container being capable of retaining a pressurized propellent;

a valve assembly attached to said container for controlling the dispensing of said product, said valve assembly including:

a valve body having a fluid chamber;

a valve stem having an inlet and an outlet, said valve stem being movable within said valve body between a closed position where said valve stem inlet is not in fluid communication with said fluid chamber and an open position where said valve stem inlet is in fluid communication with said fluid chamber;

a first valve inlet for providing fluid communication between one portion of said container and said fluid chamber;

a second valve inlet for providing fluid communication between another portion of said container and said fluid chamber;

a closing member positioned within said fluid chamber for closing one of said valve inlets, thus preventing fluid communication through said one of said inlets, said member being movable between said inlets within said fluid chamber under the influence of forces external to the valve, the position of said member within said fluid chamber being dependent on said external forces acting on said valve; and means for retaining said closing member at one of said inlets independent of said external forces acting on said valve.

2. The pressurized dispenser according to claim 1 wherein said retaining means is responsive to movement of said valve stem from said closed position to said open position, said retaining means being operational after said valve stem reaches a predetermined retaining point.

3. The pressurized dispenser according to claim 2 wherein said retaining means operates prior to said valve stem reaching said open position and therefore, before said valve stem inlet communicates with said fluid chamber.

4. The pressurized dispenser according to claim 3 further comprising means for selectively restricting said member to a range of movement between said retaining point and said open position.

5. The pressurized dispenser according to claim 4 wherein said selective restricting means includes detents located along said valve stem and said valve body, said detents being adapted to engage at said retaining point.

6. The pressurized dispenser according to claim 1 wherein said valve stem outlet is adapted to secure a nozzle portion, said stem being movable along a vertical axis.

7. The pressurized dispenser according to claim 6 wherein said fluid chamber is positioned between 30 and 45 degrees from a horizontal plane perpendicular to said vertical axis.

8. The pressurized dispenser according to claim 1 wherein said valve stem further comprises said retaining means.

9. The pressurized dispenser according to claim 1 wherein said closing means includes a weighted ball movable within a path in said fluid chamber between said first and second valve inlets.

10. The pressurized dispenser according to claim 9 wherein said valve stem in said open position prevents movement of said ball between said first and second valve inlets.

11. The pressurized dispenser according to claim 1 further comprising means for sealing said valve stem inlet from said fluid chamber, thereby preventing fluid communication therebetween.

12. The pressurized dispenser according to claim 1 wherein said sealing means includes a sealing disc adapted to seal said stem inlet from said fluid chamber in said closed position and communicate said valve stem inlet with said fluid chamber in said open position.

13. The pressurized dispenser according to claim 1 further comprising means for biasing said valve stem towards said closed position.

14. The pressurized dispenser according to claim 1 wherein said valve assembly operates with said container in an upright position.

15. The pressurized dispenser according to claim 1 wherein said valve assembly operated with said container in an inverted position.

16. A valve for dispensing fluid supplied under pressure from a container, said valve comprising:

a valve body having a fluid chamber;

a tubular valve stem having an inlet and an outlet, said valve stem being movable within said valve body between a closed position where said stem inlet is not in fluid communication with said fluid chamber and an open position where said stem inlet is in fluid communication with said fluid chamber;

a first valve inlet for providing fluid communication between one portion of said container and said fluid chamber;

a second valve inlet for providing fluid communication between another portion of said container and said fluid chamber;

a closing member positioned within said fluid chamber for closing one of said valve inlets, thus preventing fluid communication through said one of said inlets, said member being movable between said inlets within said fluid chamber under the influence of forces external to the valve, the position of said member within said fluid chamber being dependent on said external forces acting on said valve; and means for retaining said closing member at one of said inlets independent of said external forces acting on said valve.

17. The valve according to claim 16 wherein said retaining means is responsive to movement of said valve stem from said closed position to said open position, said retaining means being operational after said valve stem reaches a predetermined retaining point.

18. The valve according to claim 17 wherein said retaining means operates prior to said valve stem reaching said open position and therefore, before said valve stem inlet communicates with said fluid chamber.

19. The valve according to claim 18 further comprising means for selectively restricting said valve stem to a range of movement between said predetermined retaining point and said open position. predetermined retaining point.

20. The valve according to claim 16 wherein said valve stem outlet is adapted to secure a nozzle portion, said stem being movable along a vertical axis.

21. The valve according to claim 20 wherein said fluid chamber is positioned between 30 and 45 degrees from a horizontal plane perpendicular to said vertical axis.

22. The valve according to claim 16 wherein said valve stem further comprises said retaining means.

23. The valve according to claim 16 wherein said closing member includes a weighted ball movable within a path in said fluid chamber between said first and second valve inlets.

24. The valve according to claim 23 wherein said valve stem in said open position prevents movement of said ball between said first and second valve inlets.

25. The valve according to claim 16 further comprising means for sealing said valve stem inlet from said fluid chamber, thus preventing fluid communication therebetween.

26. The valve according to claim 16 wherein said sealing means includes a sealing disc adapted to seal said valve stem inlet from said fluid chamber in said closed position and communicate said valve stem inlet with said fluid chamber in said open position.

27. The valve according to claim 16 further comprising means for biasing said valve stem towards said closed position.

28. The valve according to claim 16 wherein said valve operates in an upright position.

29. The valve according to claim 16 wherein said valve operates in an inverted position.

* * * * *